United States Patent [19]

Piltz

[11] Patent Number: 4,917,259

[45] Date of Patent: Apr. 17, 1990

[54] END CLOSURE FOR A PACKAGING CONTAINER

[75] Inventor: Lars-Erik Piltz, Dalby, Sweden

[73] Assignee: AB Akerlund & Rausing, Sweden

[21] Appl. No.: 210,608

[22] Filed: Feb. 10, 1989

[30] Foreign Application Priority Data

Feb. 16, 1988 [SE] Sweden ..... 8800515

[51] Int. Cl.[4] ..... B65D 41/50

[52] U.S. Cl. ..... 220/270

[58] Field of Search ..... 220/270, 258; 215/254, 215/251

[56] References Cited

U.S. PATENT DOCUMENTS 3,200,985 8/1965 Ashley ..... 220/270

FOREIGN PATENT DOCUMENTS 8306089-7 3/1986 Sweden .

*Primary Examiner*—Donald F. Norton

*Attorney, Agent, or Firm*—Lerner, David, Littenberg, Krumholz & Mentlik

[57] ABSTRACT

Through a centrally placed ingot there is formed an injection moulded cover or end closure for a packaging container comprising at least an outer layer and an easy opening device formed therein, the device having a grip and a tearing denotation starting therefrom. The tearing device includes a first tearing denotation which merges into a circumferential tearing denotation extending inwardly adjacent the periphery of the outer layer and a second tearing denotation spaced from said first tearing denotation and spaced inwardly of said circumferential tearing denotation and extending in a generally spiral shaped path. These tearing denotations, together with a blind groove, define a wide material flow region and several material flow passages through which injected material will flow when exiting the centrally placed ingot. The injected material is channeled out of the material flow regions through the material flow passages in such a way as to form an easily openable container end closure with a tearing device having sharp, well-defined edges.

4 Claims, 1 Drawing Sheet

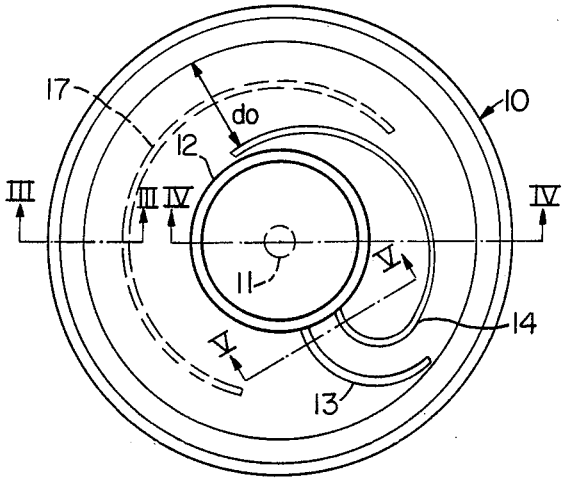
FIG. 1
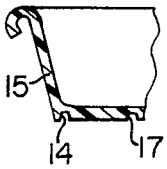
FIG. 3
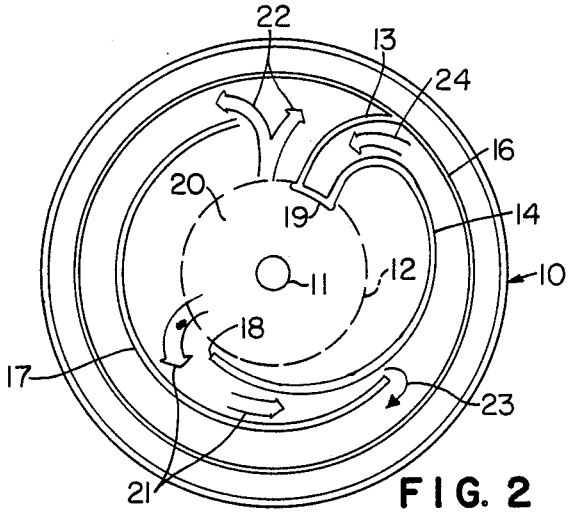
FIG. 2
FIG. 4
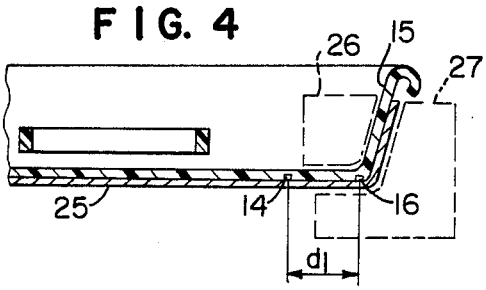
FIG. 5
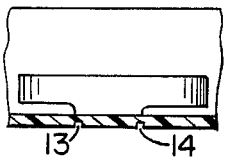

END CLOSURE FOR A PACKAGING CONTAINER

FIELD OF THE INVENTION

The present invention relates to an end closure for a packaging container.

BACKGROUND OF THE INVENTION

The literature describes several solutions to the problems associated with easily openable containers and end closures therefore. There are, for instance, devices for opening containers of metal, plastics, cardboard or combinations of such materials. Nevertheless, the consumer frequency complains that no totallY acceptable solution has been realized.

Among the most frequent consumer complaints are that easy openable end closures crack in an uncontrolled manner, require a very high tearing force, and/or leave doubt as to the integrity of the container, i.e. whether or not the package has been opened previously.

Thus, an easy opening device represents a sort of paradox in that it should give an impression of a stable, impermeable barrier which is simultaneously simple to use for exposing the contents of the container.

Therefore, it is an object of the present invention to provide an end closure which addresses the deficiencies that have plagued the art.

SUMMARY OF THE INVENTION

The present invention relates to an end closure having a rigid appearance giving an impression of confidence but still having a certain flexibility or freedom of movement.

The present invention provides a closure for a packaging container, comprising at least one outer layer having an easy opening device arranged therein. The device has a grip which is attached to a tearing strip formed between a plurality of tearing denotations starting out from the grip. The tearing strip comprises a first weakening line or tearing denotation which merges into a circumferential tearing denotation extending inwardly adjacent the periphery of the outer layer and a second weakening line or tearing denotation spaced from said first tearing denotation and spaced inwardly of the circumferential tearing denotation and extending in a generally spiral shaped path.

The end closure is characterized in that between the end of the second tearing denotation and the grip and the first, second and circumferential tearing denotation there is formed a wide material flow region, and in that a further material weakening reduction of the wall thickness in the shape of a blind groove is formed. The blind groove has a substantial extension in the circumferential direction and bridges over and further defines the material flow region, but leaves at least one flow opening for a circumferential deflection of the material flow at either end of the material flow region. These flow openings are material flow passages through which injected material passes and is deflected during the formation of the end closure.

One of the material flow passages is arranged for guiding the injection molded material flow circumferentially in the area between the blind groove and the tearing denotation located close to the rim.

In one embodiment the easy opening device and blind groove are formed in an outer layer of an end closure, where a second tearable layer is attached to the outer layer, at least in the tearing denotation regions. Thus, the tearable layer is removable by means of the grip and the tearing strip.

Generally, the outer material layer is considerably thicker than the inner material layer, and in this case the blind groove has the function of also providing a flexible end closure.

BRIEF DESCRIPTION OF THE DRAWINGS

FIG. 1 in a view from above, shows the end closure or a cover according the invention;

FIG. 2 shows the cover seen from below;

FIG. 3 is a partial section along line III—III in FIG. I;

FIG. 4 is a further partial section along line IV—IV in FIG. 1, and

FIG. 5 is a section along line V—V.

DETAILED DESCRIPTION OF THE PREFERRED EMBODIMENTS

The end closure 10 in FIG. 1 is an integral injection moulded unit that is injection molded in one shot through a centrally placed ingot 11.

The material from which the closure may be produced may, for instance, be polypropylene or any other suitable injection moldable, thermoplastic material. The thickness of the closure 10 varies, but as a whole the closure 10 is a very thin-walled, injection molded unit of a complex shape. The maximum thickness of the closure 10 should range from about 1 to about a few millimeters, and the regions forming the tearing denotations and blind groove have a thickness of between about 1 and about a few tenths of a millimeter.

From a centrally placed grip 12 in the shape of a pull ring there extends grooves 13 and 14 forming a pair of tearing denotations. The first denotation 13 merges into a circumferential tearing groove or tearing denotation 16 extending adjacent a periphery or rim 15 of the outer layer and formed at the base region of a circumferential rim 15. The second tearing denotation 14, however, is deflected upwards in FIG. 1 and describes a generally spirally shaped path over an angle of a bit more than 180°. The distance from the circumferential tearing denotation 16 varies from the measured $d_1$ according to FIG. 4 to a somewhat larger measure $D_0$ at the end of the tearing denotation 14.

In the bottom part of the closure 10, as illustrated in FIG. 2, there is also formed a so-called blind groove 17 having a generally circumferential extension. In one embodiment, the blind groove 17 extends circumferentially over an arc of about 270°. The groove bridges over a material flow region 20 defined by one end 18 of the tearing denotation 14 and the transition region 19 between the grip 12 and the tearing denotations 13 and 14 as well as by the blind groove. Thwe blind groove 17 and the reduced wall thickness thereof implies a slowing down of the material flow from the ingot 11 in a direction upwards, meaning that the flow of material primarily is deflected into heavy flow in the direction of the arrows 21, and also as a material flow in the direction of the double arrow 22, i.e. through the material flow passages.

Thus, the tearing denotation 14 will be delimited by a tangential or circumferential flow of material 21 in a direction radially outwards, and said flow will interrupt the kind of radial orientation of the material which otherwise takes place in this region. The effect of this is that the tearing groove 14 will be easier to handle and it will provide a considerably sharper and more well-defined tearing line. The arrow 23 indicates a corresponding circumferential flow of material along the tearing denotation 16, i.e., the circumferential denotation extending all of the way around the closure, meaning that a more well-defined tearing denotation will be formed because the otherwise radial flow of material from the ingot 11 will be interrupted. The arrow 24 defines a further preferable orientation of the material along the tearing denotation 13.

In addition to providing well-defined, easy-openable characteristics, the blind groove 17 has the further function of giving the closure a certain flexibility. Such flexibility aids in maintaining the structural integrity of the end closure during impact. Thus in the case where a container having the end closure of the present invention is dropped, the force caused by the contents of the package impacting upon the inside of the closure will be attenuated very quickly.

The ability to form sharp, well-defined tearing denotations is, of course, one function which directly affects tearability of the tear strip formed thereby. Tearability is especially important when the closure 10 is combined with an inner layer 25 of a flexible material, for instance, a plastic coated metal foil, metalized plastic film, or flexible high barrier plastic laminate. As shown in FIG. 4, a circular blank 25 of flexible material may be welded or attached to the lower side of the outer layer 10. The circular blank 25 may have a diameter generally equal to that of the circumferential tearing denotation 16. However, it is preferred that the circular blank 25 have a diameter in excess of that of the circumferential tearing denotation 16 such that the circular blank 25 will extend to, and be placed in intimate contact with the outside of rim 15. The circumferential blank 25 may be welded to the entirety of the closure 10 or welded to the tearing strip over a distance of $d_1$ such that the circular blank will be broken along the circumferential denotation 16. This provides for a well-defined, smooth tearing edge of the circular blank 25, roughly along the circumferential tearing denotation 16.

The size of the weld is not important as long as an efficient weld joint exists on both sides of the circumferential tearing denotation 16, and preferably is obtained by using a circumferentially extending welding jaw 26 of the HF or induction welding type and an external conical recess acting as a support 27. Due to the fact that the blind groove 17 provides a broken orientation of the flow of material along the tearing denotation 16, the inner layer 25 will be broken through a smooth and proper tearing line.

We claim:

1. An end closure for a packaging container comprising: at least an outer layer formed by injection molded material having an easy opening device arranged therein including a grip, a circumferential tearing denotation inwardly adjacent a periphery of said outer layer, a first tearing denotation extending from said grip to said circumferential tearing denotation, a second tearing denotation spaced from said first tearing denotation and spaced inwardly of said circumferential tearing denotation and extending in a generally spiral shaped path, and a blind groove inwardly spaced from said circumferential tearing denotatio and extending generally circumferentially about a material flow region defined thereby and by said first, second, and circumferential tearing denotations, said blind groove and said first tearing denotation and said blind groove and said second tearing denotation further defining a plurality of material flow passages through which injected material will flow when exiting said material flow region, whereby an outer layer is formed including sharp and well defined tearing denotations.

2. The end closure of claim 1 further comprising a second tearable layer attached to said outer layer on at least both sides of said circumferential tearing denotation extending adjacent said periphery of said outer layer.

3. The end closure of claim 1 wherein at least one material flow passage is arranged such that injected material will flow circumferentially in the area between said blind groove and said circumferential tearing denotation.

4. The end closure of claim 2 wherein said outer layer is thicker than said inner layer.

* * * * *

UNITED STATES PATENT AND TRADEMARK OFFICE

CERTIFICATE OF CORRECTION

PATENT NO. : 4,917,259

DATED : April 17, 1990

INVENTOR(S) : Lars-Erik Piltz

It is certified that error appears in the above-identified patent and that said Letters Patent is hereby corrected as shown below:

On the cover page:

"[21] Appl. No.: 210,608" should read --Appl. No.: 310,608--

Signed and Sealed this

Sixteenth Day of July, 1991

*Attest:*

*Attesting Officer*

HARRY F. MANBECK, JR.

*Commissioner of Patents and Trademarks*